US011149978B1

(12) United States Patent
Amery et al.

(10) Patent No.: US 11,149,978 B1
(45) Date of Patent: Oct. 19, 2021

(54) WINDOW VENT ASSEMBLY FOR PORTABLE AIR CONDITIONER

(71) Applicant: Danby Products Limited, Guelph (CA)

(72) Inventors: Parwaiz Amery, Guelph (CA); Dennis O'Brien, Hamilton (CA); Gregory Allan Thomas Hall, Guelph (CA)

(73) Assignee: DANBY PRODUCTS LIMITED, Guelph (CA)

( * ) Notice: Subject to any disclaimer, the term of this patent is extended or adjusted under 35 U.S.C. 154(b) by 436 days.

(21) Appl. No.: 16/238,036

(22) Filed: Jan. 2, 2019

Related U.S. Application Data

(60) Provisional application No. 62/618,708, filed on Jan. 18, 2018.

(51) Int. Cl.
*F24F 13/08* (2006.01)
*F24F 13/02* (2006.01)
*F24F 1/04* (2011.01)

(52) U.S. Cl.
CPC ..... *F24F 13/084* (2013.01); *F24F 1/04* (2013.01); *F24F 13/0209* (2013.01); *F24F 13/0254* (2013.01); *F24F 13/0272* (2013.01); *F24D 2200/31* (2013.01); *F24F 2221/125* (2013.01)

(58) Field of Classification Search
CPC .. F24F 13/084; F24F 13/0254; F24F 13/0272; F24F 13/224; F24F 13/18; F24F 1/04; F24F 1/031; F24F 1/027; F24F 2221/125; F24F 2221/20; F24D 2200/31; E04G 3/28
USPC ..... 454/201
See application file for complete search history.

(56) References Cited

U.S. PATENT DOCUMENTS 4,267,618 A * 5/1981 Cuscovitch ..... A47L 11/34 15/246.2
4,334,461 A * 6/1982 Ferguson ..... F24F 7/00 285/189
6,564,512 B1 * 5/2003 Whittemore ..... B08B 15/00 248/694
8,578,728 B2 * 11/2013 Cho ..... E06B 7/03 62/262
8,728,597 B2 * 5/2014 Beele ..... H02G 3/22 428/36.5

(Continued)

OTHER PUBLICATIONS

Hubertjass, "How to install a portable A/C unit into a casement window", May 3, 2013, https://www.youtube.com/watch?v=fu1u1HoBtUs (Year: 2013).*

*Primary Examiner* — Kenneth J Hansen
*Assistant Examiner* — Dana K Tighe
(74) *Attorney, Agent, or Firm* — Ralph E. Jocke; Walker & Jocke

(57) ABSTRACT

A window vent assembly (15) is usable with a swing out window assembly (20) to provide an outlet for a vent hose (12) of a portable air conditioner (10). The assembly includes a substantially rigid, transparent sheet (16) with a plurality of scored break lines (46, 48, 50, 52) which enable changing the size of the sheet to close a frame opening (22) of a window frame (18). A plurality of releasably engageable clips (62, 64) enable the sheet to be releasably held in closing relation with the frame opening. A sleeve (114) is releasably engageable with the vent hose to enable venting of the heat removed by the air conditioner from the window through a sheet opening (14) in the sheet.

21 Claims, 18 Drawing Sheets

(56) References Cited

U.S. PATENT DOCUMENTS

| | | | | |
|---|---|---|---|---|
| 2008/0134584 | A1* | 6/2008 | McGhee | E06B 7/32 49/484.1 |
| 2016/0097547 | A1* | 4/2016 | Selg | B01D 46/4227 62/293 |
| 2016/0363330 | A1* | 12/2016 | Kim | F24F 13/20 |
| 2017/0254557 | A1* | 9/2017 | Chiu | F24F 1/04 |

* cited by examiner

WINDOW VENT ASSEMBLY FOR PORTABLE AIR CONDITIONER

TECHNICAL FIELD

Exemplary embodiments relate to portable air conditioners. Exemplary embodiments provide a window vent assembly that can be used with a portable air conditioner and a window that rotates outward from a frame about a vertically extending axis.

BACKGROUND

Portable air conditioner units are highly versatile in cooling selected areas of homes or other buildings. However, portable air conditioner units generally include a vent hose which must be connected to the area outside the building in order to discharge the heat that is removed from the building interior. Assemblies that are usable to provide a vent opening that are connectable to the vent hose of a portable air conditioner have been developed for windows that have a horizontally movable or a vertically movable sash. Such assemblies strive to provide a generally air tight arrangement through which heat is exhausted by the air conditioner and expelled from the building, and the assembly does not allow insects or contaminants in the environment external of the building to enter the building interior.

Many window assemblies include a window that rotates relative to a frame about a vertical axis. The window swings outwardly from the frame about the vertical axis between an open position and a closed position. The use of a portable air conditioner with such a window type may present greater challenges than other window configurations and window vent assemblies for portable air conditioners in general may benefit from improvements.

SUMMARY

Exemplary arrangements relate to a window vent assembly configured for use with a portable air conditioner. The portable air conditioner may be of the type that has an air vent hose for expelling heat that is transferred by the air conditioner from the interior of the building in which the air conditioner unit is located. The exemplary arrangements are particularly suited for use with a window that swings outwardly from a frame that bounds a rectangular opening. The window moves in operatively supported connection with the frame about a vertical axis between a closed position in which the window closes the frame opening, and an open position in which at least one lateral side of the window is disposed outward of the frame opening.

The exemplary window vent assembly includes a generally rigid plastic sheet. The plastic sheet is rectangular and includes four straight outer sides and four square corners. The exemplary plastic sheet is transparent and may be comprised of an acrylic material. The sheet includes a plurality of scored break lines that each extend parallel to one of the outer sides. The break lines are configured to enable separation of sheet portions by the application of bending force along the respective line. By separating the sheet portions at the break lines the remaining sheet can be made to correspond in size to the frame opening of the particular window.

The exemplary sheet further includes a plate portion. The plate portion includes a sheet opening that is configured to be operatively connected to a vent hose of a portable air conditioner. The exemplary plate portion does not include break lines and is configured to be a part of the remaining sheet that is sized for closing the frame opening.

The exemplary assembly further includes a plurality of first and second self-adhesive clips. Each first clip includes a projection, and each second clip includes a recess configured to engage a respective projection. Each of the clips are adhesively attached in fixed relation with one of the sheet or the frame. The engagement of the respective first and second clips is usable to hold the sheet in fixed engagement with the frame and to close the frame opening so that when the window is in the open position, the air conditioner is enabled to be vented through the vent hose that is in operative connection with the sheet opening.

DETAILED DESCRIPTION OF EXEMPLARY EMBODIMENTS

Figure 1:
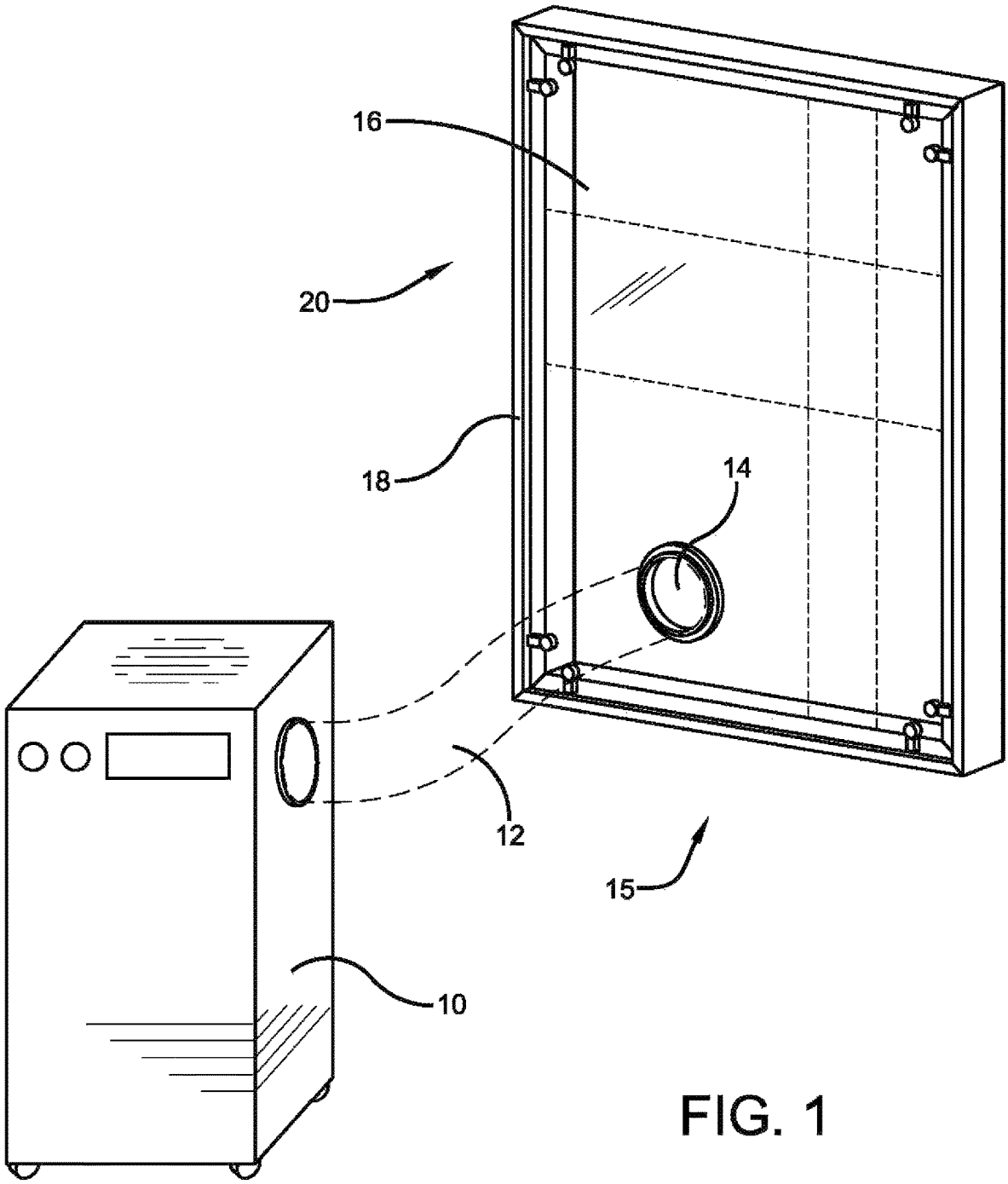
FIG. 1 is a schematic view of a portable air conditioner in operative connection with an exemplary window vent assembly.

Referring now to the drawings and particularly to FIG. 1, there is shown therein schematically a portable air conditioner generally indicated 10. Air conditioner 10 is of the type generally used in a household or other building interior area to cool a selected room or other space. The air conditioner 10 operates to transfer heat from the area in which the air conditioner 10 is positioned to the external environment outside the space to be cooled. The exemplary air conditioner transfers the heat from the room being cooled by exhausting heated air from the air conditioner through a vent hose 12.

In the exemplary arrangement the vent hose 12 is in operative fluid connection with a window vent assembly 15 that includes a sheet opening 14 in a sheet 16. This sheet 16 which is later described in detail, is in releasable attached connection with a frame 18 of a swing out window assembly 20.

Figure 2:
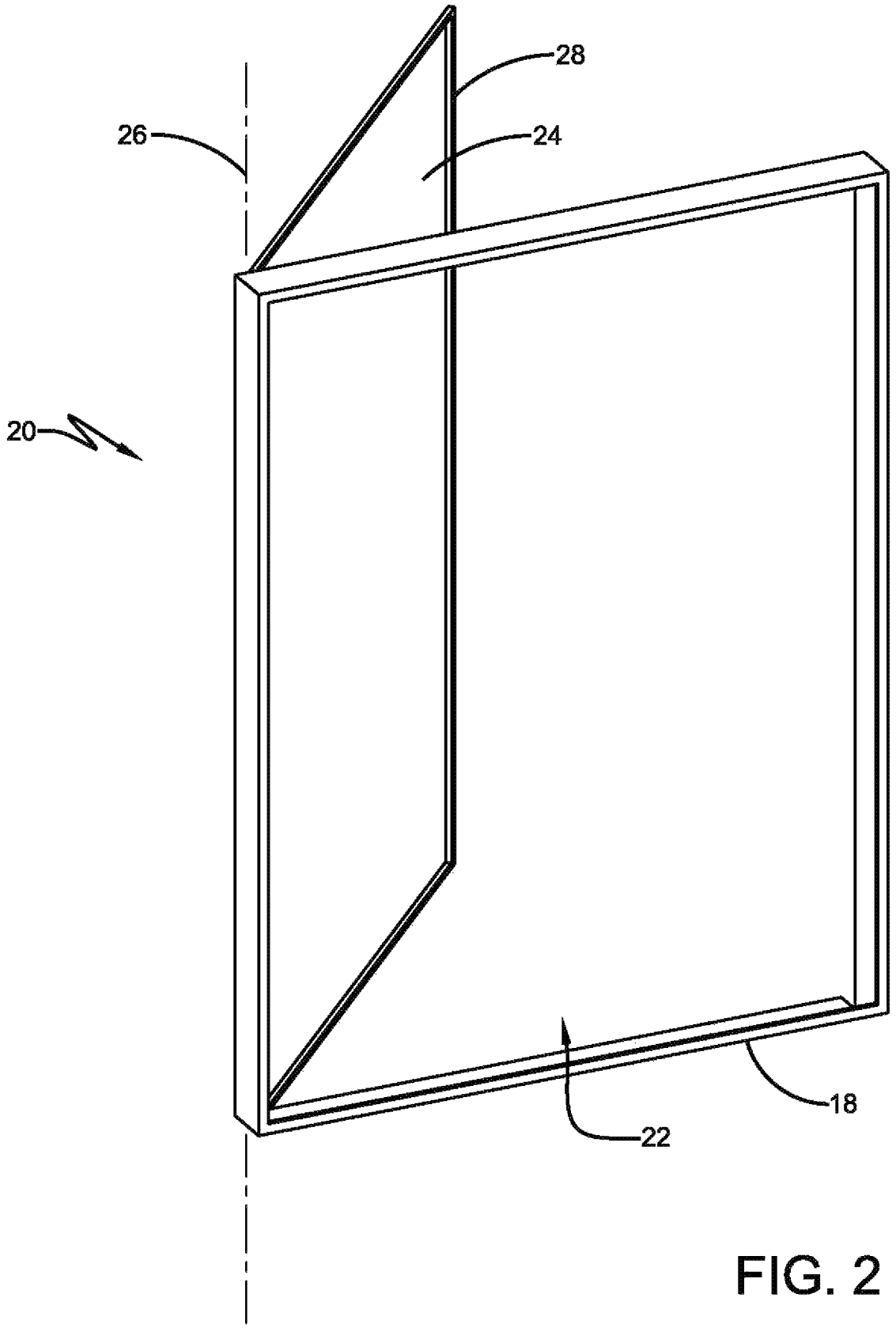
FIG. 2 is a perspective view of an exemplary swing out window and a frame with which the exemplary window vent assembly may be used.

As shown in FIG. 2 the exemplary swing out window assembly 20 includes the frame 18 which is in fixed operative connection with the wall or other fixed building structure to which the window is connected. The frame bounds a frame opening generally indicated 22. A window 24 is movably mounted in operative connection with the frame 18. The window 24 is rotationally movable relative to the frame about vertical axis 26. In the exemplary arrangement the window is selectively movable between a closed position in which the window 24 closes the frame opening 22, and an open position in which at least the one lateral side 28 of the window 24 is disposed outwardly from the frame opening 22. Of course it should be understood that this configuration of a swing out window is exemplary and another embodiments other window arrangements may be used.

Figure 3:
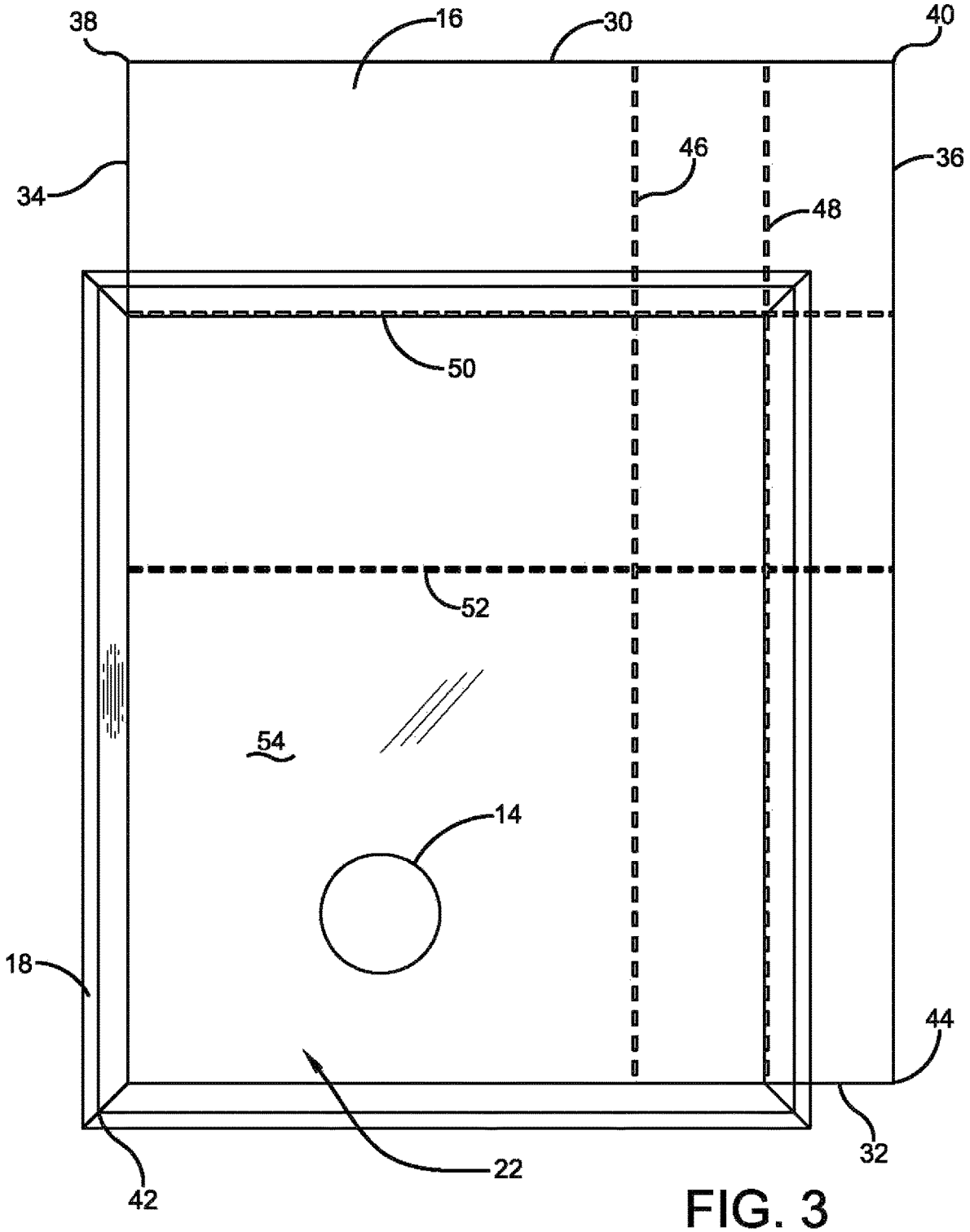
FIG. 3 shows an exemplary sheet positioned adjacent to the window frame, showing the break lines used for changing the size of the sheet to correspond to the frame opening.

As shown in FIG. 3 the exemplary sheet 16 is a substantially rectangular sheet that is bounded by four straight linear sides, including top and bottom sides 30, 32 respectively, and lateral sides 34 and 36. The exemplary sheet 16 further includes four square corners 38, 40, 42 and 44. The exemplary sheet 16 is comprised of a substantially rigid transparent plastic material such as an acrylic material. The sheet includes a plurality of break lines 46, 48, 50 and 52. Each of the break lines extends parallel to one of the outer sides that initially bounds the sheet 16. The exemplary sheet further includes a plate portion 54. The exemplary plate portion 54 is a rectangular portion that includes the sheet opening 14 therein. The plate portion 54 also does not include any break lines therethrough. Of course it should be understood that this arrangement is exemplary and in other embodiments other arrangements may be used.

In the exemplary arrangements shown each of the break lines comprises a scored break line that includes a cut that extends partially through the sheet. In the exemplary arrangement the cuts include a plurality of disposed relatively short aligned cuts that extend transversely into the sheet from the inner surface thereof. In the exemplary arrangement the break lines are each configured to enable separation of sheet portions from the sheet by the application of bending force that is applied along to the respective break line. This exemplary arrangement enables sheet portions to be separated from the sheet 16 such that the remaining sheet corresponds to the size of the frame opening of the window assembly that is to be closed by the sheet. In the exemplary arrangement the sheet is made to include break lines that correspond to the usual standard sizes of window openings that need to be closed using the window vent assembly 15.

Figure 4:
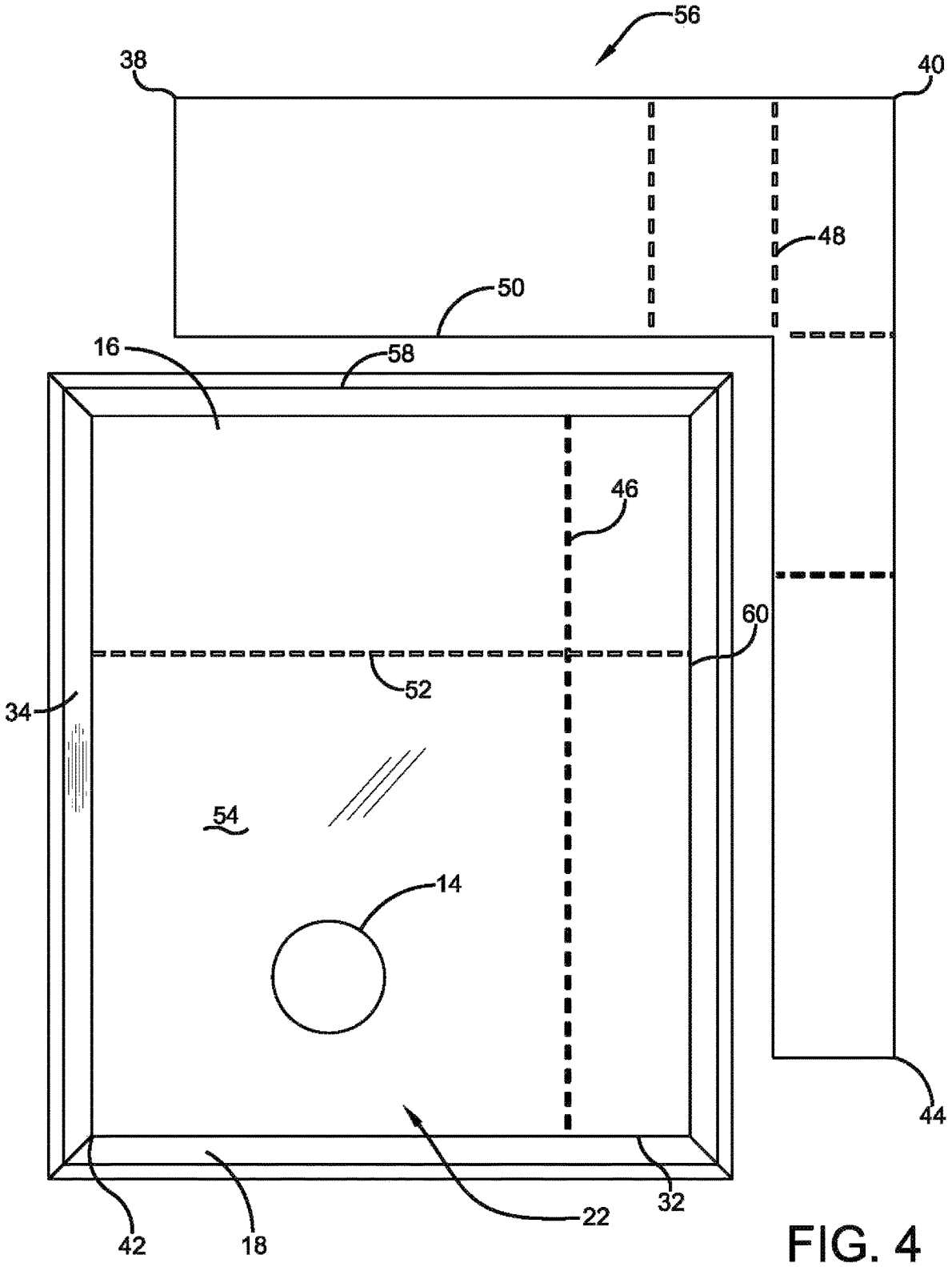
FIG. 4 shows unneeded portions of the sheet separated from the remainder of the sheet at the break lines, and the remaining sheet positioned in the frame opening.
Figure 5:
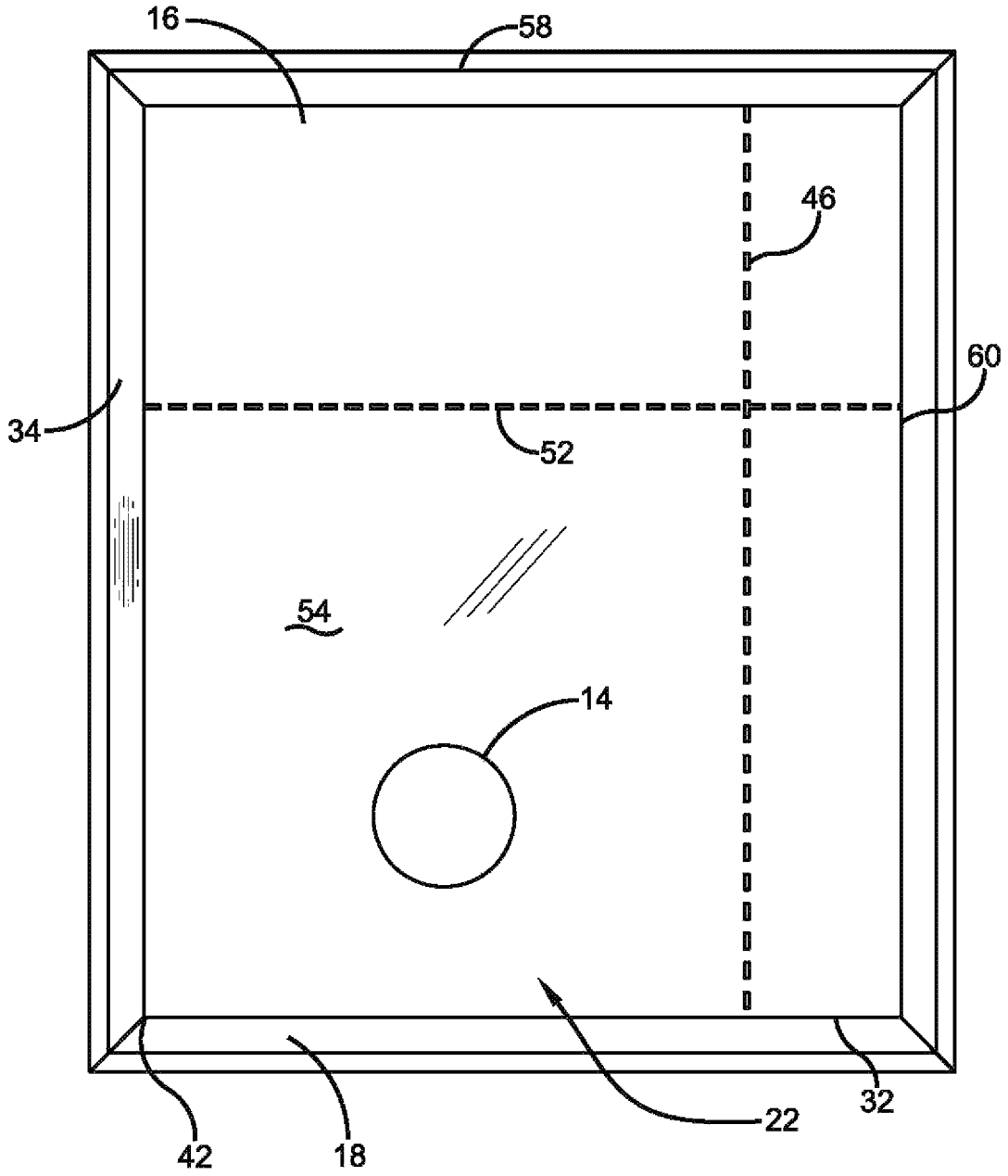
FIG. 5 shows the remaining sheet positioned in closing relation of the frame opening.

In the exemplary arrangement as shown in FIG. 3, the frame opening 22 of frame 18 is smaller than the original size of sheet 16. In order to change the size of the sheet 16 to correspond in size to the frame opening that is required to be closed, sheet 16 has portions separated therefrom along break line 48 and break line 50. This is represented in FIG. 4. As shown in FIG. 4 with the separation of the portions 56 along break lines 48 and 50, the remaining sheet 16 is sized for closing the opening 22.

As shown in FIG. 4 with the remaining sheet in generally abutting relation with the frame 18 and closing the frame opening 22, the plate portion 54 is positioned with the corner 42 thereof in engagement with an inside corner of the frame 18. Remaining unfractured break lines 46 and 52 continue to bound the plate portion 54. Bottom side 32 and lateral side 34 continue to bound the periphery of the remaining sheet 16 on two sides, while newly exposed top side 58 and lateral side 60 bound the remaining sheet on the other two sides. In the exemplary arrangement the frame 18 includes a frame opening 22 that closely corresponds to the periphery of the remaining sheet 16 such that the sheet can extend in closing relation with the opening. However in other arrangements the sheet periphery may be positioned somewhat outside the frame opening and still be held in position closing the frame opening using the exemplary window vent assembly.

In the exemplary arrangement the sheet is held in closing relation with the frame opening by a plurality of self adhesive clips. The self adhesive clips include first clips 62 and second clips 64. As shown in FIGS. 6 through 9, clips 62 include a base 66 and a top 68. The top 68 is rotatably movable relative to the base. The top 68 includes an outward extending projection 70 thereon.

Figure 6:
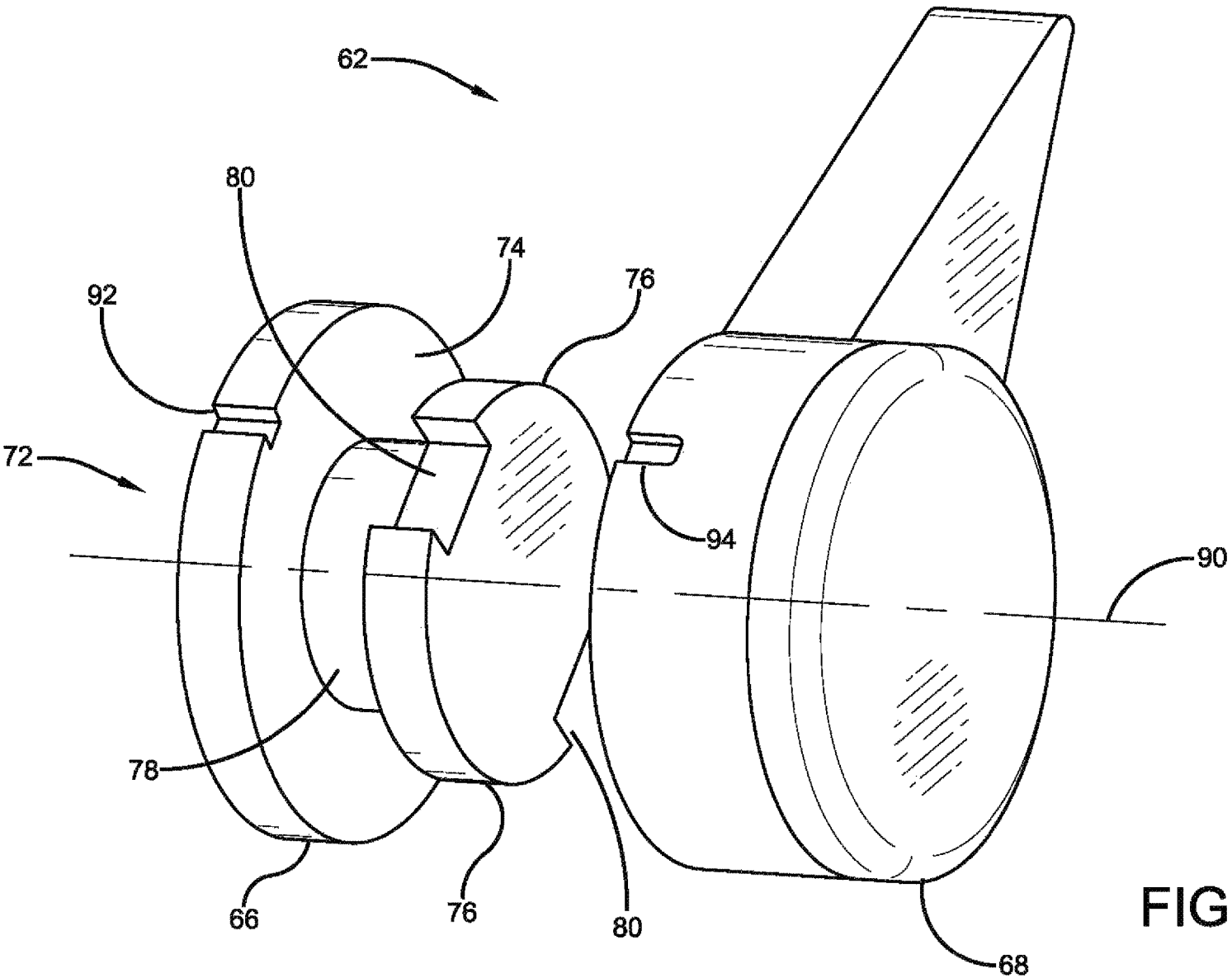
FIG. 6 is an exploded view of an exemplary first self-adhesive clip.

As shown in FIG. 6 the base 66 of exemplary clip 62 includes a first side 72. First side 72 includes an adhesive face. The adhesive face includes an adhesive that is suitable for attaching the base 66 in fixed connection with either the sheet 16 or the frame 18. Exemplary base 66 further includes a second side opposed side 74. Side 74 includes radially extending arcuate projections 76 thereon. The radially extending arcuate projections are supported on a circular boss 78 such that they extend outward away from the second side 74 of the base. The radially extending arcuate projections 76 are separated by arcuate openings 80 that extend axially between the projections.

Figure 7:
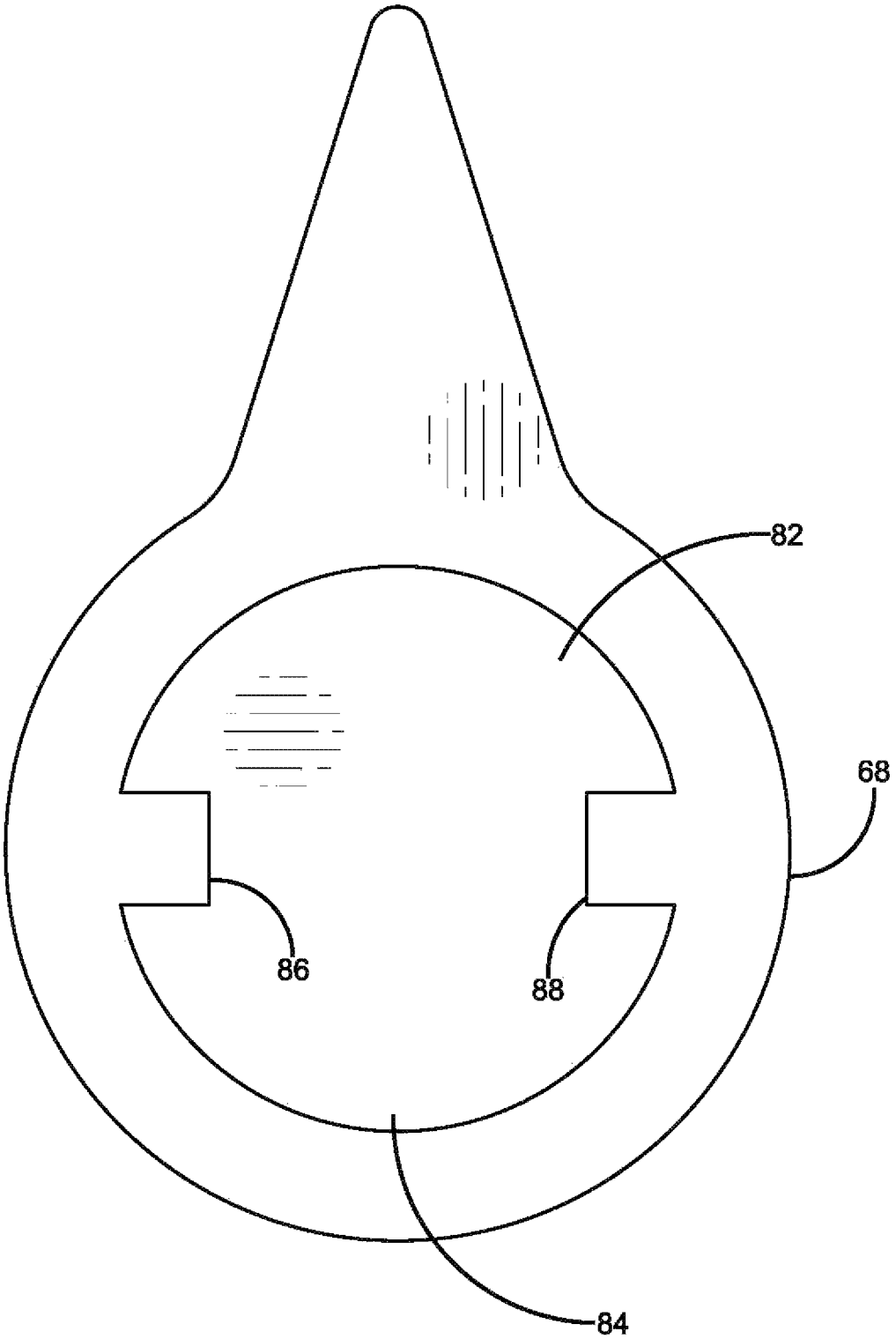
FIG. 7 is a bottom view of a top of the first clip.
Figure 9:
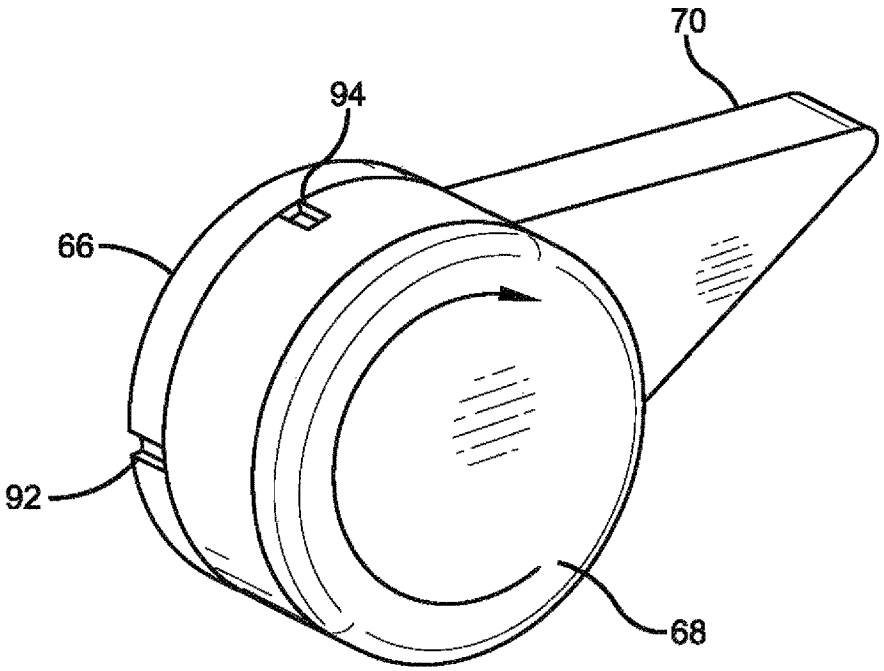
FIG. 9 is a perspective view of the first self-adhesive clip rotated in a clockwise direction from the position shown in FIG. 8.

As shown in FIG. 7 the exemplary top 68 includes a pair of radially extending arcuate recesses 82, 84. Recesses 82 and 84 are bounded by radially inwardly extending projections 86, 88. The arcuate recesses are continuous within the top 68 above the inward extending projections 86 and 88 so that the radially extending arcuate projections 76 of the base may be accepted therein while the projections 86 and 88 hold the top 68 in engagement with the base 66.

As can be appreciated from FIG. 6, the exemplary projections 86, 88 are configured so that they may be extended in the direction of axis 90 through the arcuate openings 80. In this relative rotational position of the base 66 and the top 68, the base and top can be brought into engagement and then the top rotated relative to the base such that the projections 86, 88 extend below the arcuate projections 76 of the base. In this configuration the projections 86, 88 and the arcuate projections 76 are operative to hold the top and the base in rotatable movable engagement. Rotating the top 68 relative to the base 66 such that the projections 86, 88 are aligned with and fully within the arcuate openings 80, enables the top and the base to be moved axially relative to one another such that the top and the base become separable and may be disengaged. Of course it should be understood that in other embodiments the arrangements of projections and recesses in the base and the top may be reversed.

Figure 8:
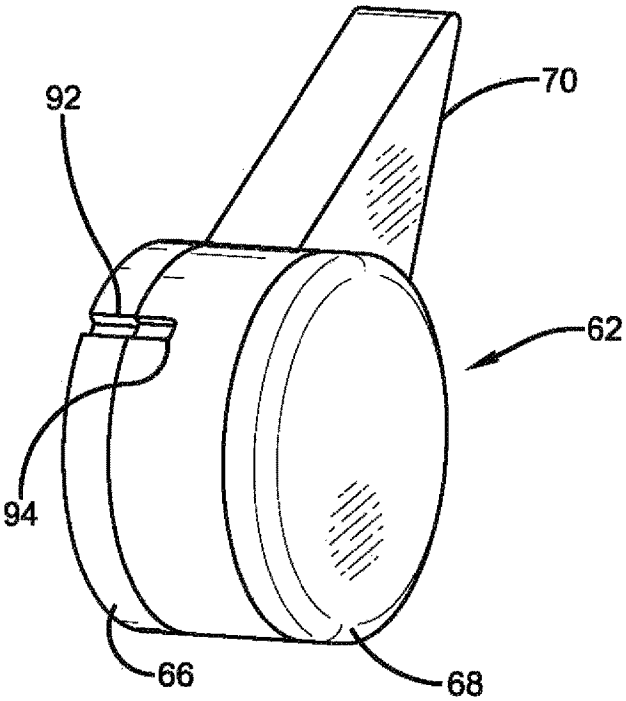
FIG. 8 is a perspective view of the assembled first self-adhesive clip.

In the exemplary arrangement the base 66 includes an externally visible mark 92 on its periphery and the top 68 includes an externally visible mark 94. In the exemplary arrangement these marks are usable to indicate to the user the rotational position in which the top 68 and the base 66 are engageable and separable. For example as shown in FIG. 8 the alignment of the marks 92, 94 indicate that the top 68 may be disengaged from the base 66. With the top 68 rotated relative to the base 66 as represented by the arrow in FIG. 9, the marks 92, 94 are no longer aligned which indicates that the top and the base are in inseparable rotatable engagement. As later discussed, the marks 92, 94 are also useful in connection with the exemplary embodiment for purposes of enabling a user to visually position the base 66 in position for the top of the clip to engage a respective recess of a second clip 64.

Figure 10:
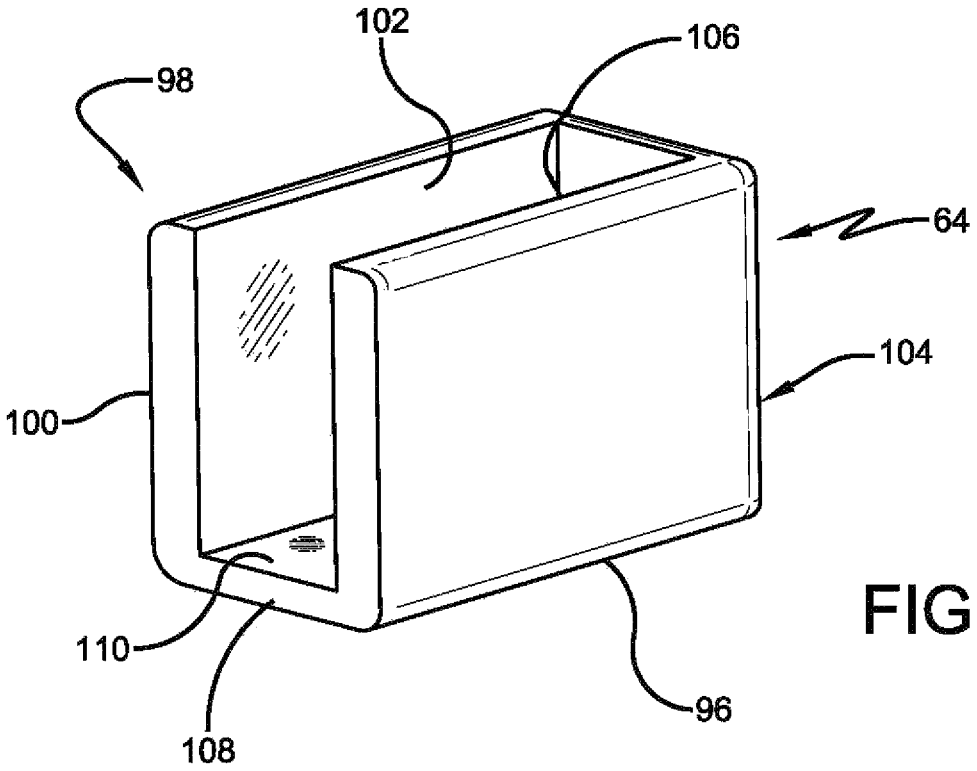
FIG. 10 is a perspective view of an exemplary second self-adhesive clip.

An exemplary second self adhesive clip 64 is shown in FIG. 10. The exemplary clip 64 includes a body 96. The body 96 bounds a recess 98. The exemplary body 96 includes a substantially planar body side 100 which includes an adhesive face. The adhesive face is suitable for engaging the body 96 in fixed attached engagement with one of the sheet 16 and the frame 18. The exemplary body side 100 includes an outer face 102 which bounds the recess 98.

The exemplary clip 64 further includes a substantially planar body side 104. Body side 104 extends substantially parallel to body side 100 and is disposed therefrom. Second body side 104 includes an inner face 106 which also bounds the recess 98. Exemplary body 96 further includes a bounding wall 108. Bounding wall 108 extends transversely between the inner face 106 and the outer face 102. Bounding wall 108 further includes a face 110. Face 110 also bounds the recess 98.

Figure 11:
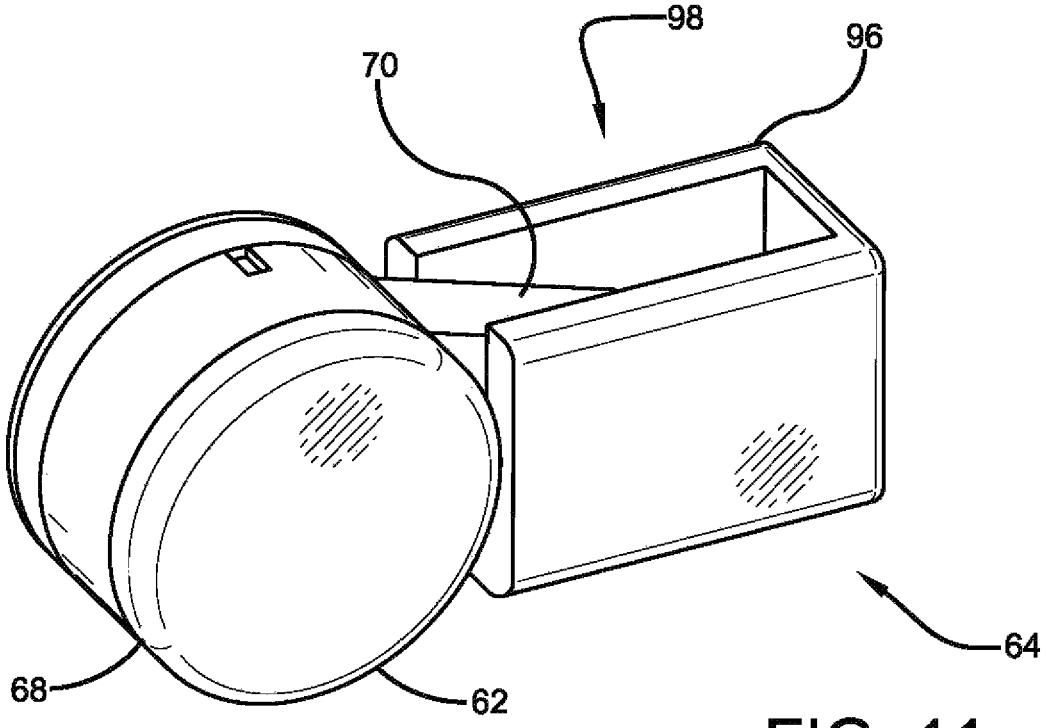
FIG. 11 is a perspective view of a projection of the first clip engaged in the recess of the exemplary second clip.

In the exemplary embodiment the substantially rectangular body 96 bounds the recess 98 on at least two sides, and in the exemplary embodiment bounds the recess on four sides. In the exemplary arrangement the body 96 includes four substantially planar sides and includes two open sides. As shown in FIG. 11 in the exemplary arrangement when a respective clip 62 is engaged with a respective clip 64, the projection 70 of the clip 62 extends in the recess 98 of the clip 64 intermediate of the inner face 106 and the outer face 102. Further the projection 70 moves into engagement in the respective recess 98 by moving rotationally through the two open sides of the body 96. Further in the exemplary arrangement, the face 110 of wall 108 is operative to engage the projection 70 in the recess and prevents further rotation of the top 68 and the projection 70 in the engaging rotational direction, once the projection 70 is fully engaged within the recess 98. Thus the engagement of the projection 70 and the face 110 stops further rotation of the top 68 in a clockwise direction as shown in FIG. 11. Counterclockwise rotation of the top 68 from the position shown in FIG. 11 moves the projection 70 to disengage from the recess 98 so that clip 62 and clip 64 can be disengaged. Of course it should be understood that this approach is exemplary and in other embodiments other approaches may be used.

Figure 12:
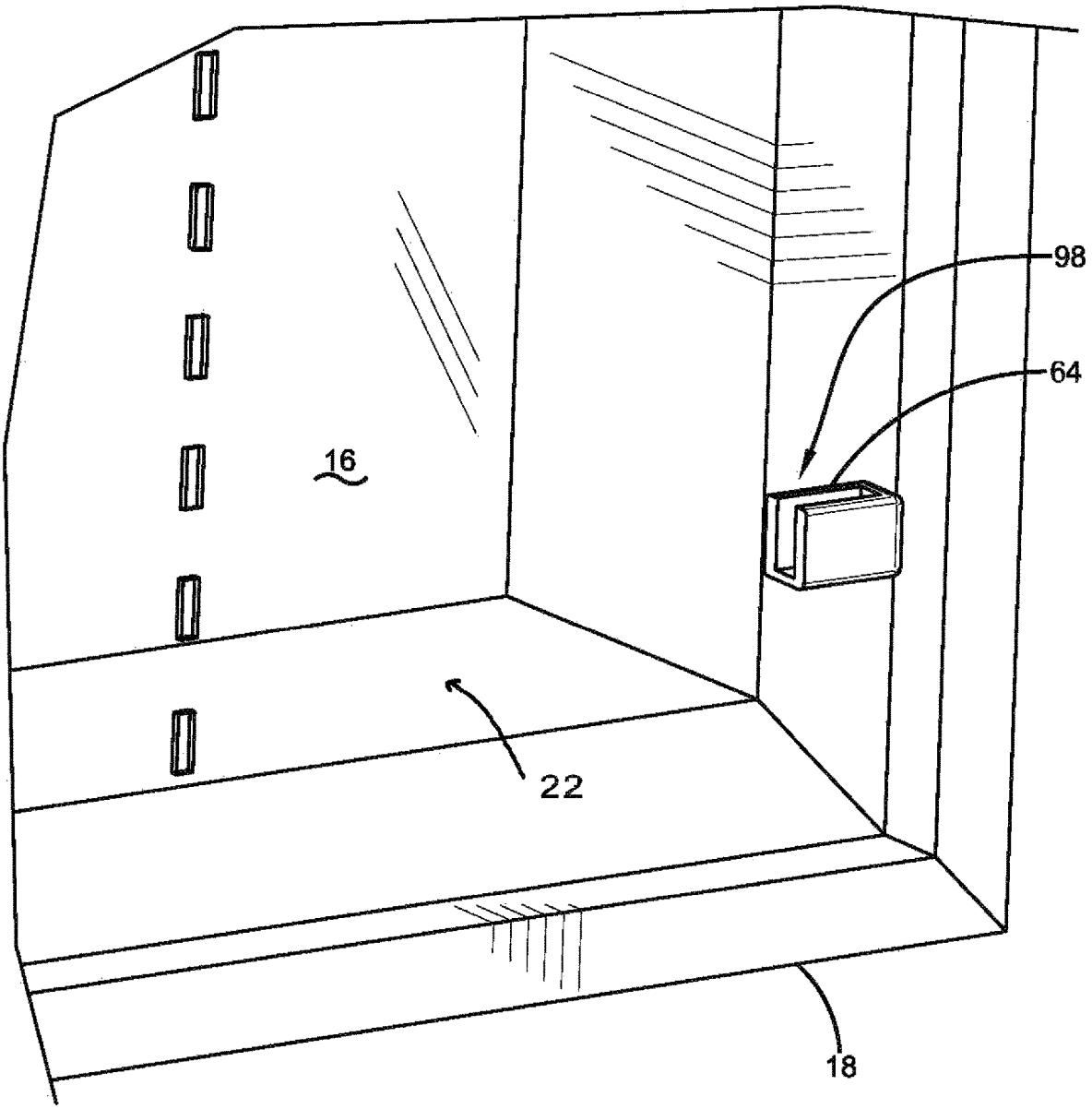
FIG. 12 is a perspective view showing the second clip in attached engagement with the frame of the window.

As represented in FIG. 12 in an exemplary arrangement each of the plurality of clips 64 are adhesively attached to the frame 18 while each of the plurality of clips 62 are adhesively attached to the sheet 60. It should be understood that this arrangement may be reversed in some installations. Alternatively in some arrangements, some of the clips 62 may be attached to the sheet 16 and others attached to the frame 18, and some of the clips 64 may be attached to the sheet and others attached to the frame. In some exemplary arrangements the adhesive sides of the respective clips may initially be covered with release paper or similar adhesive covering material which prevents the exposure of the adhesive until the respective clip is ready to be attached to the respective structure.

An exemplary sequence of installation of a respective clip 62 and a respective clip 64 is represented in FIGS. 12-15. FIG. 12 shows a clip 64 in attached relation with the frame 18 of the window. The clip 64 is positioned with the recess 98 thereof extending adjacent to a lateral side of the sheet 16. In this exemplary position the sheet 16 is enabled to be moved into and out of the frame opening 22 without being impeded by the clip 64.

Figure 13:
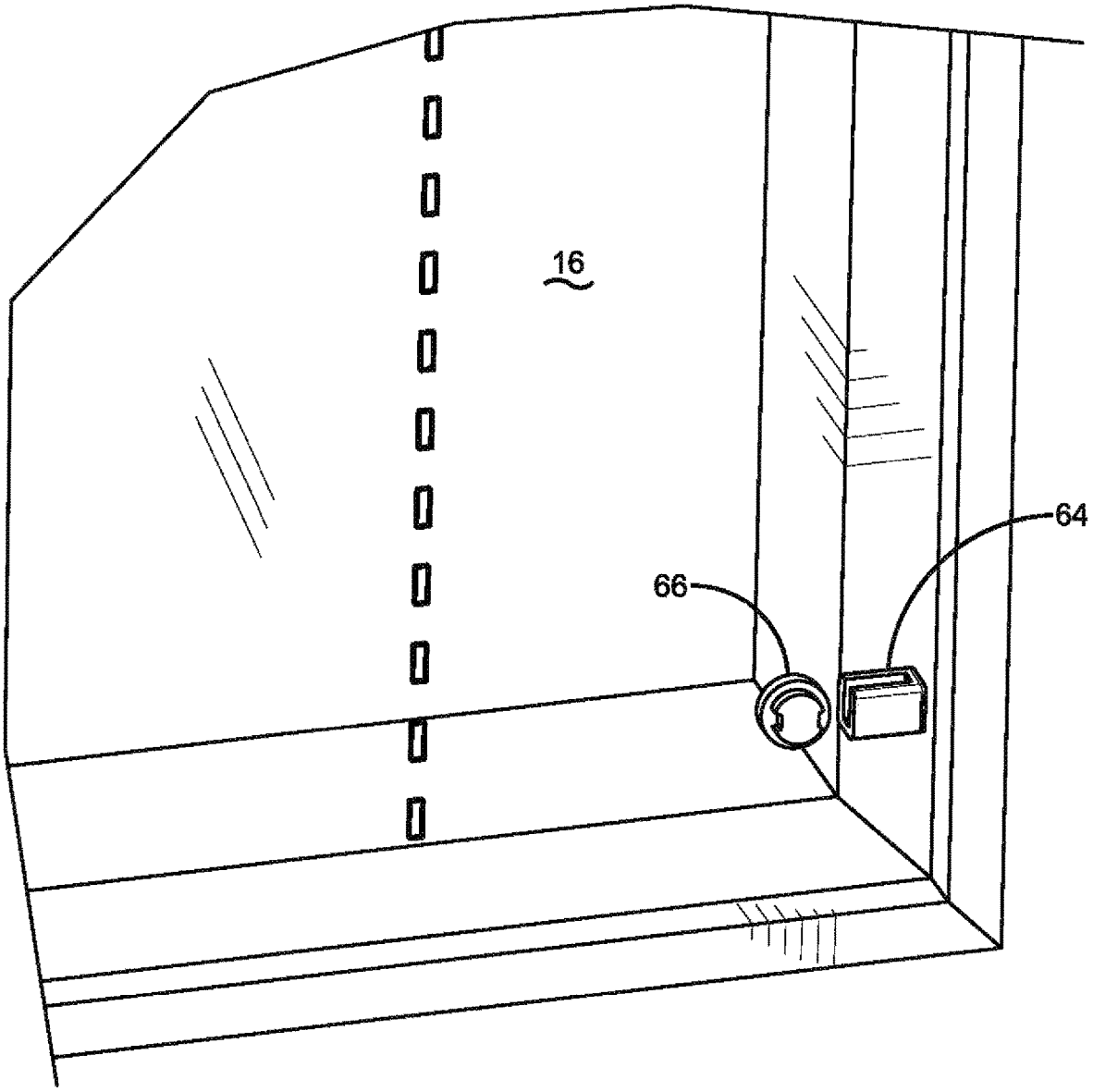
FIG. 13 is a perspective view similar to FIG. 12 and with the base of the first clip in engagement with the sheet.
Figure 14:
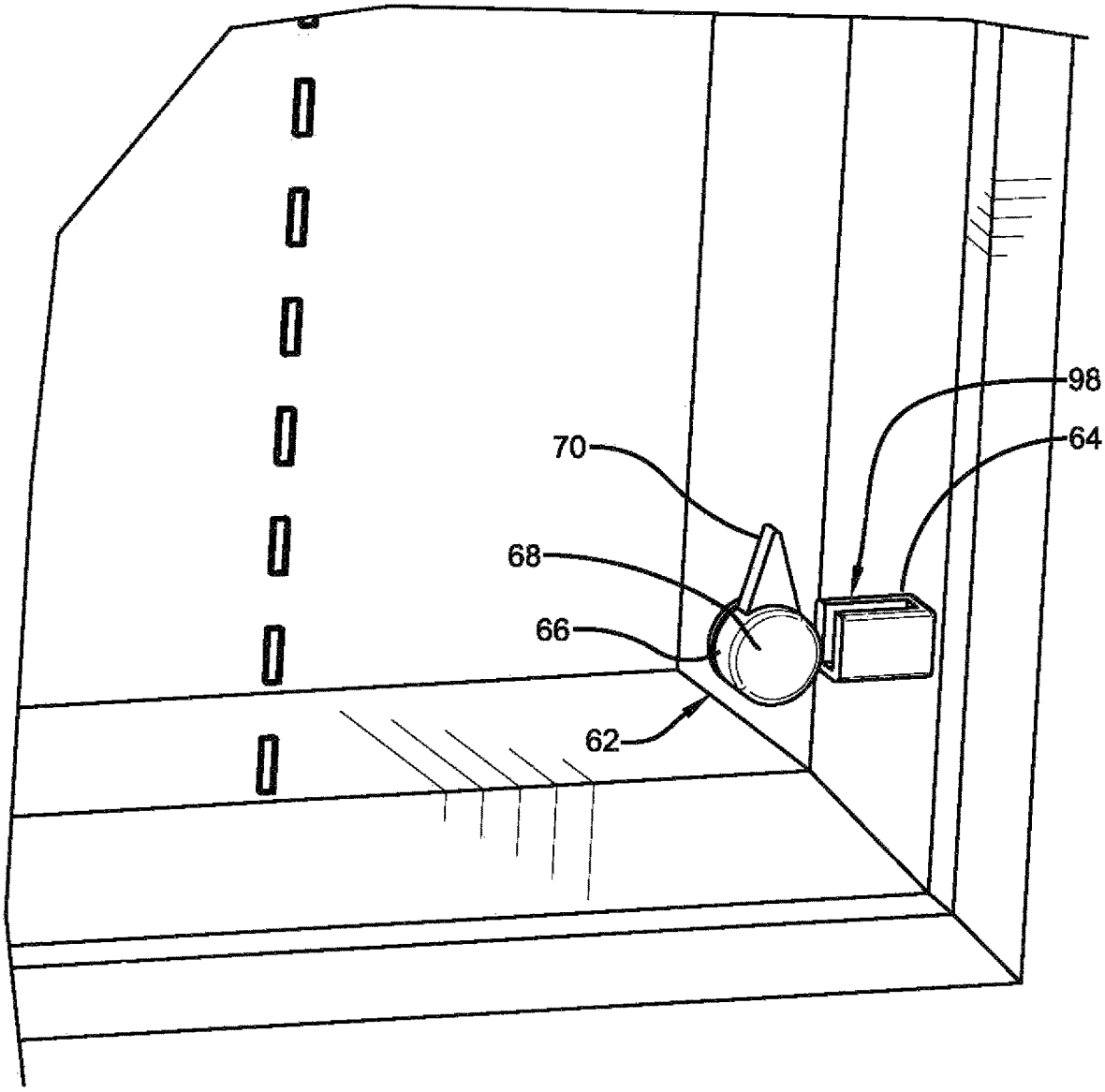
FIG. 14 is a perspective view similar to FIG. 13 but with the top of the first clip in engagement with the base and with the projection associated with the top extending outside the recess of the second clip.
Figure 15:
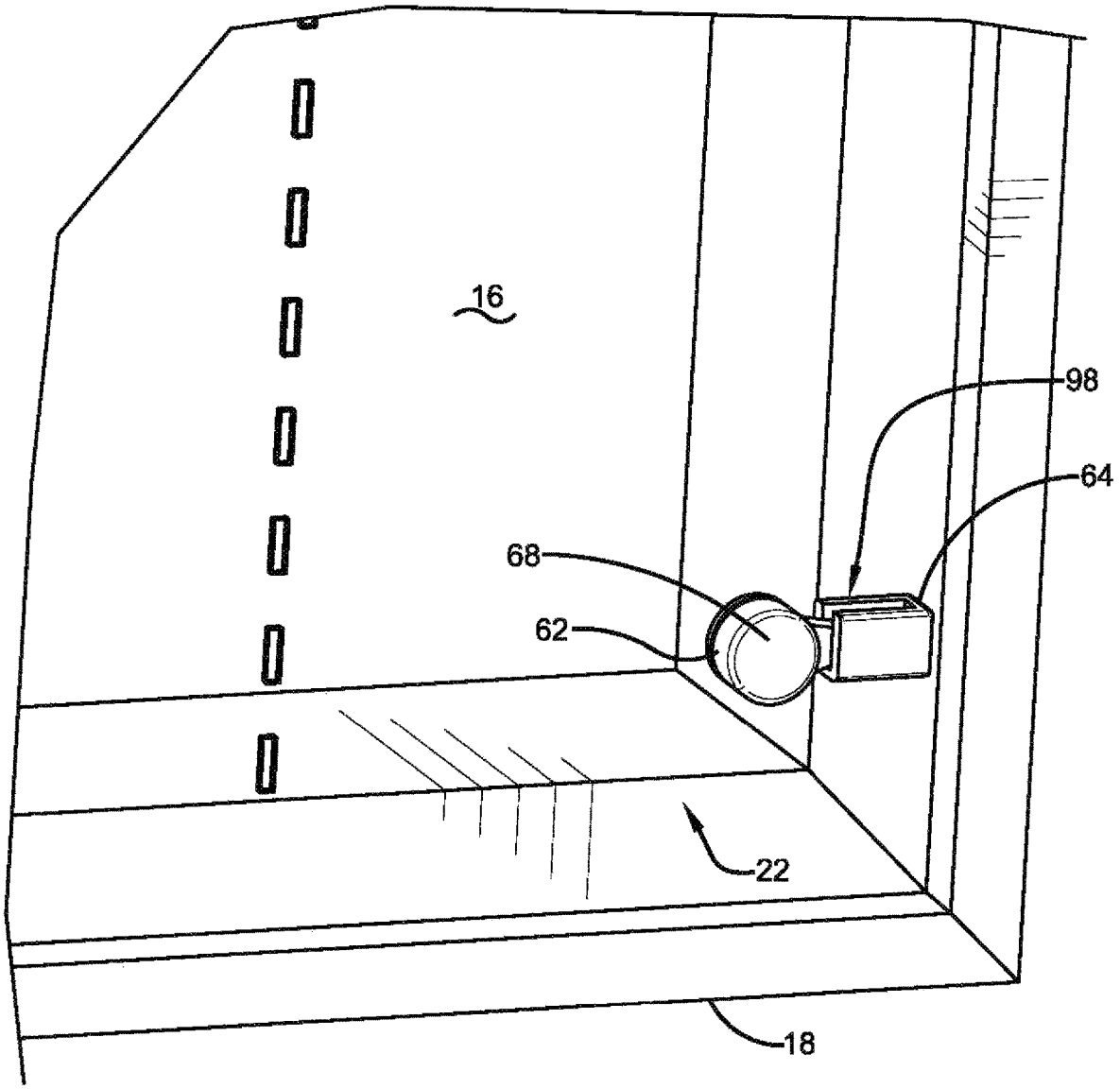
FIG. 15 is a perspective view similar to FIG. 14 but with the top of the first clip rotated such that the projection thereof is in engagement with the recess of the second clip.

FIG. 13 shows a next step in the sequence of installing the respective clips 62 and 64. A base 66 of a clip 62 is adhesively attached to the sheet 16 in adjacent aligned relation with the clip 64. The base 66 is positioned using the mark 92 so that the base is in the proper rotational position relative to the clip 64. As represented in FIG. 14 the top 68 of the clip 62 is enabled to be engaged with the base 66 by relative axial movement of the top 68 relative to the base 66 along the axis 90 of rotation of the top. When the top 68 is initially engaged with the base 66, the projection 70 of the top is positioned away from the recess 98 of the clip 64.

Once the top 68 of the clip 62 has been engaged with the base 66 thereof, the top 68 is rotatable in engagement with the base. The top 68 is rotated from the position shown in FIG. 14 in a clockwise direction as shown until the projection 70 is fully engaged within the recess 98 of clip 64. As previously discussed the engaging rotational movement of the projection 70 is stopped by the engagement of the projection with face 110 that bounds the recess 98. As can be appreciated in the exemplary arrangement, the engagement of the projection 70 of the respective clip 62 with the recess 98 of the respective clip 64 is operative to hold the sheet 16 in fixed engagement with the frame 18 and to close the frame opening 22. Further the exemplary clips 62 and 64 may be readily disengaged so that the sheet 16 may be readily removed from the opening 22 when the window vent assembly for the portable air conditioner is no longer required to be used.

Figure 16:
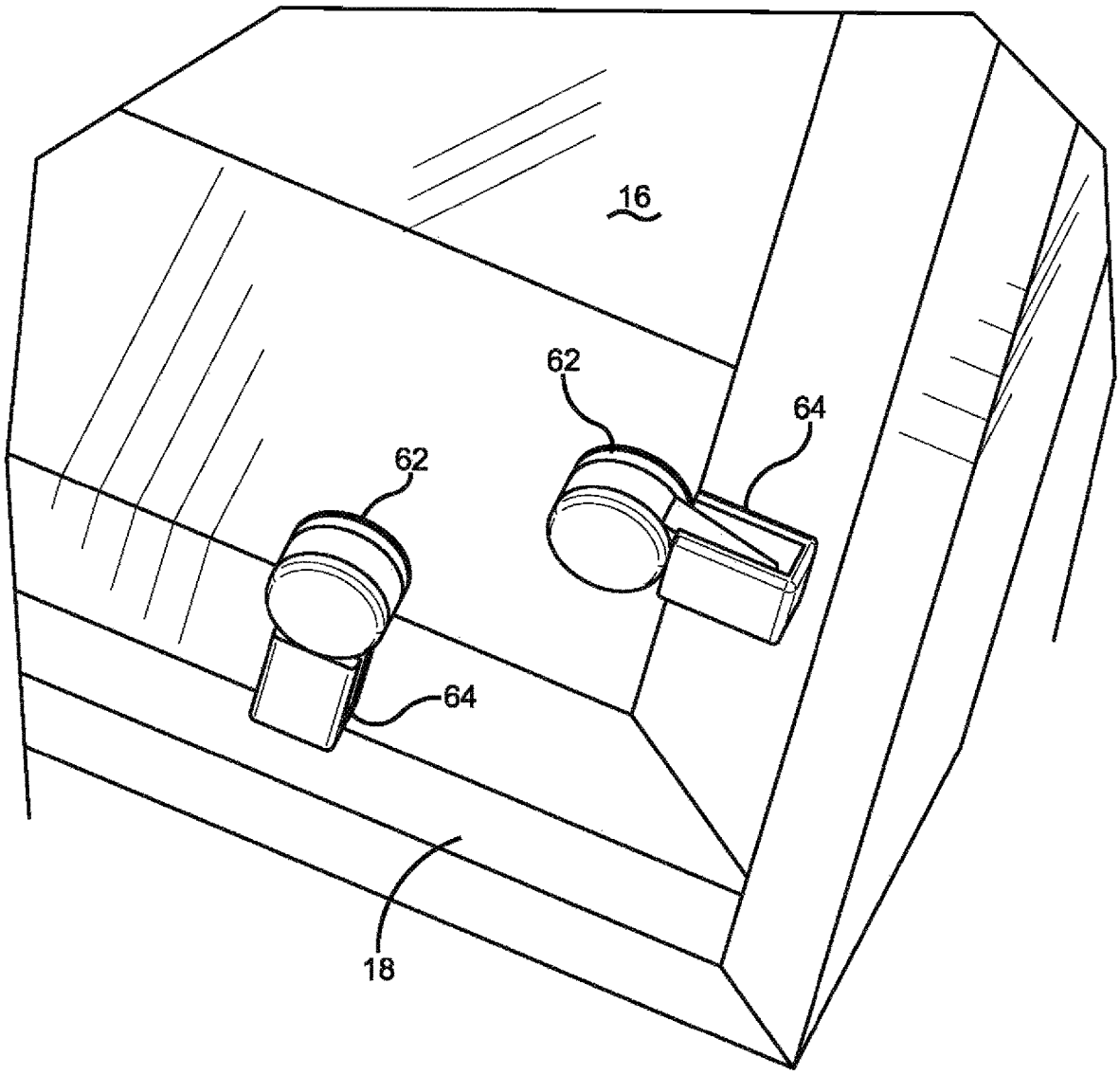
FIG. 16 is a perspective view similar to FIG. 15 showing two first clips in engagement with respective second clips on perpendicular sides of the sheet.
Figure 17:
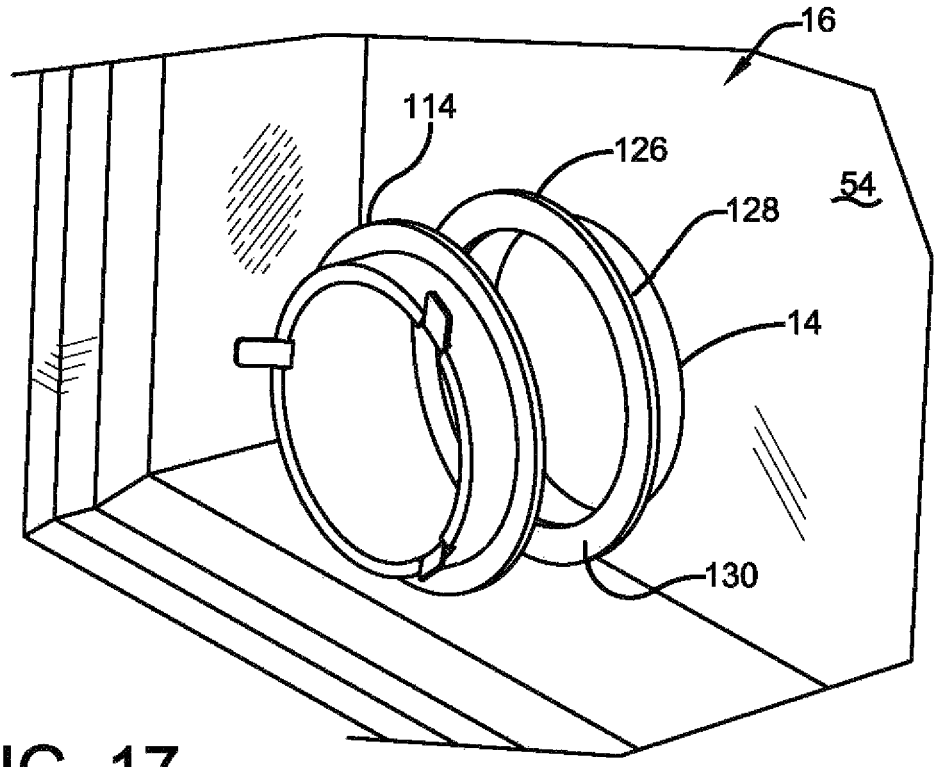
FIG. 17 is an exploded view showing the sheet opening and a sleeve configured for engaging the vent hose of the window air conditioner.
Figure 18:
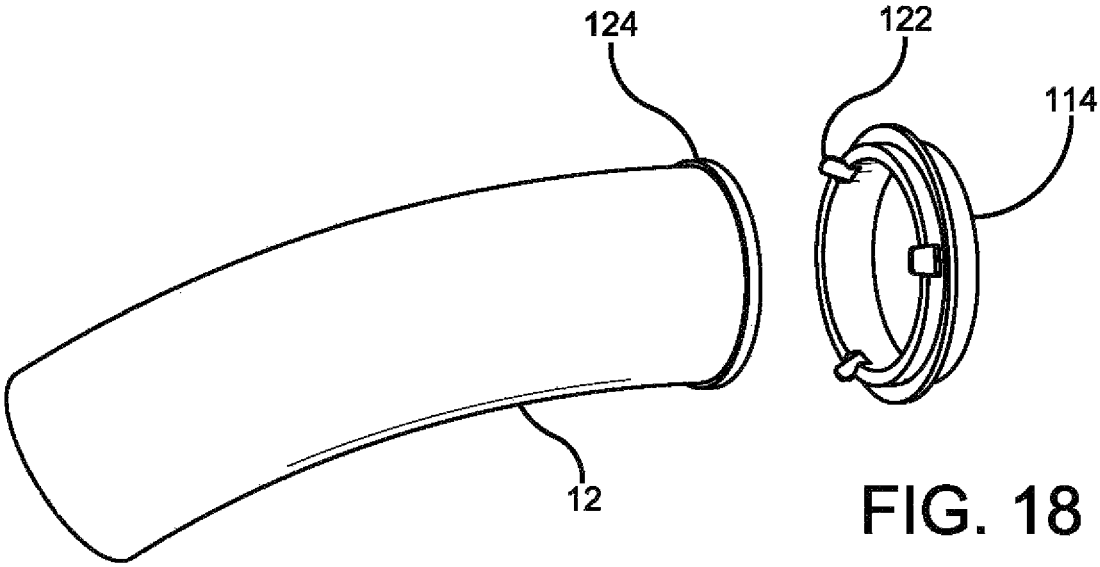
FIG. 18 is an exploded view showing the end of an exemplary vent hose and the coupling connectors on the exemplary sleeve.
Figure 19:
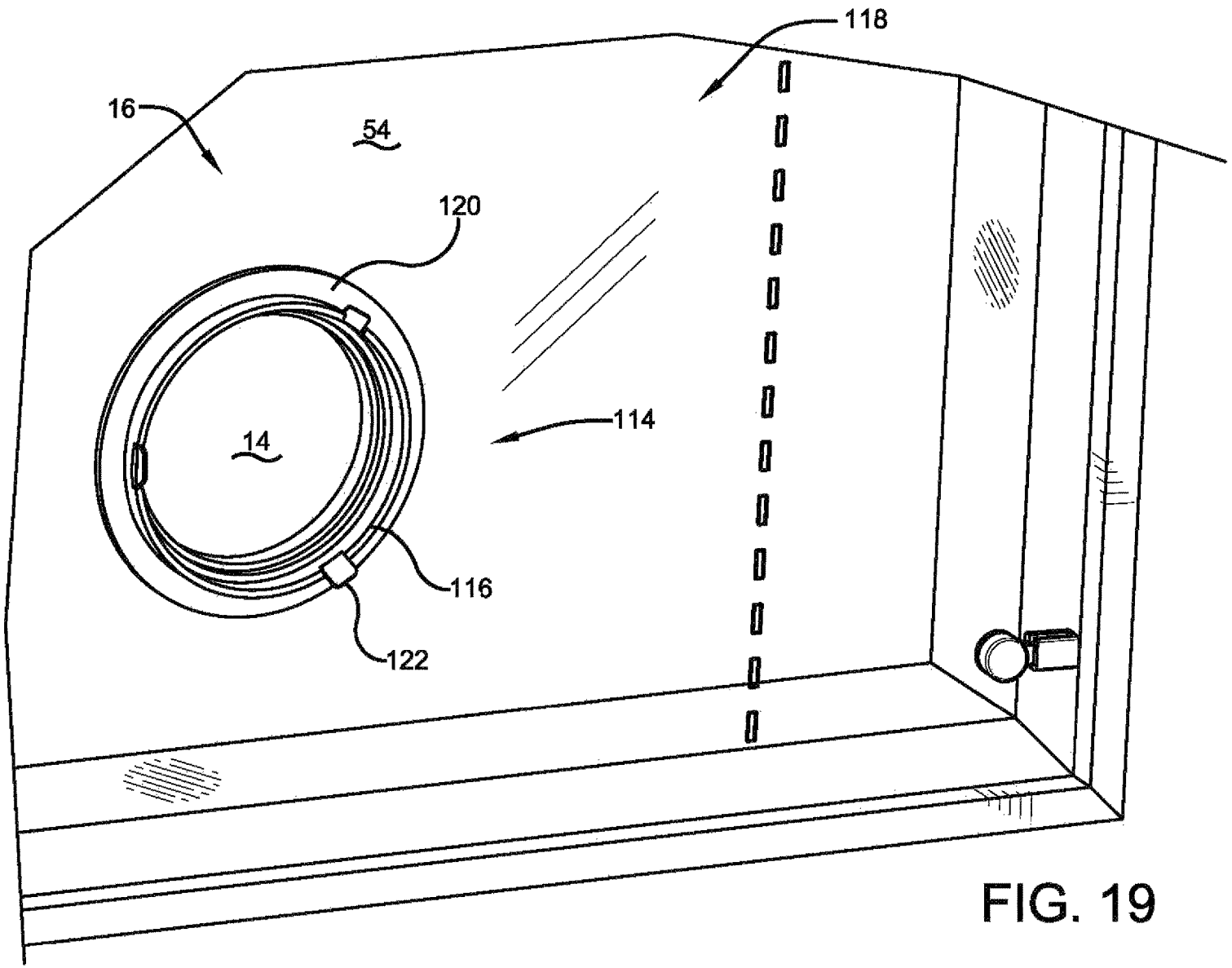
FIG. 19 is a perspective view of the sheet and the sleeve in operative connection with the sheet opening.
Figure 21:
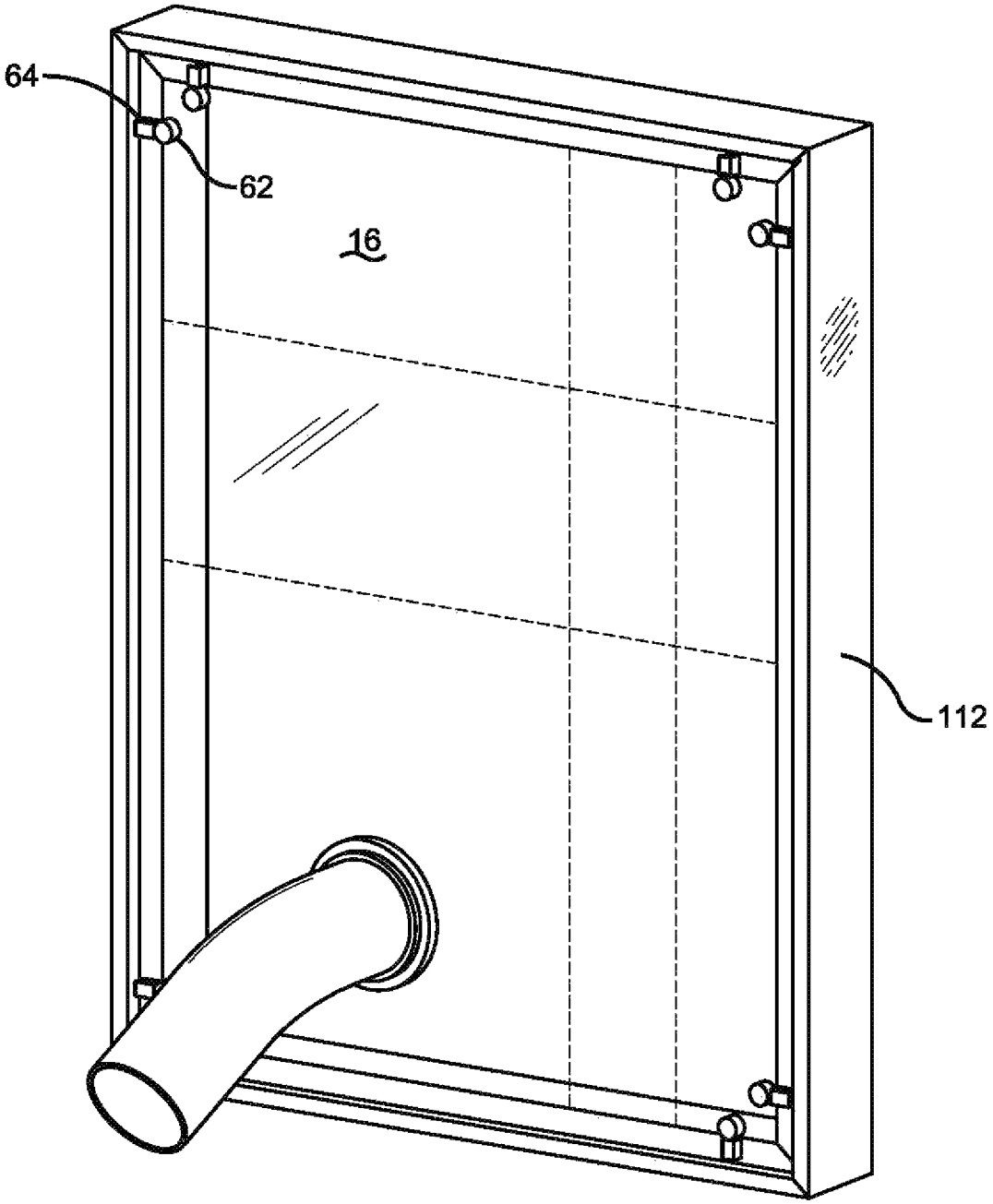
FIG. 21 is a perspective view showing an exemplary sheet in closing relation with an alternative window frame having a larger frame opening than the window frame shown in FIG. 3.

As shown in FIG. 16 a plurality of respective interengageable clips 62 and 64 may be positioned at various locations about the interface of the sheet 16 and the frame 18. The number of interengaging clips used may depend on the size of the sheet and the window opening. In exemplary arrangements the window vent assembly includes a sufficient number of clips 62 and clips 64 so that the original sized sheet 16 (before the removal of any portions at the break lines) may be held in fixed engagement and a corresponding frame opening. For example, FIG. 21 shows an alternative frame 112 in which the full-sized original sheet 16 is positioned by a plurality of clips 62 and 64.

In an exemplary arrangement the vent hose 12 associated with the portable air conditioner is connected to the sheet opening 14 through an annular sleeve 114 shown in FIGS. 17-20. The exemplary sleeve 114 includes an annular tube portion 116. Tube portion 116 is configured to extend inwardly from an inner side 118 of the plate portion 54 of the sheet 16. The sleeve 114 further includes an annular radially outward extending ring 120. The ring 120 is configured to extend in surrounding relation of the sheet opening 14. The exemplary sleeve 114 further includes a plurality of angularly disposed coupling connectors 122 thereon. The exemplary coupling connectors 122 are configured to releasably engage an annular ring 124 which is positioned at the end of vent hose 12 as shown in FIG. 14. Of course this arrangement is exemplary and other embodiments other approaches may be used.

Figure 20:
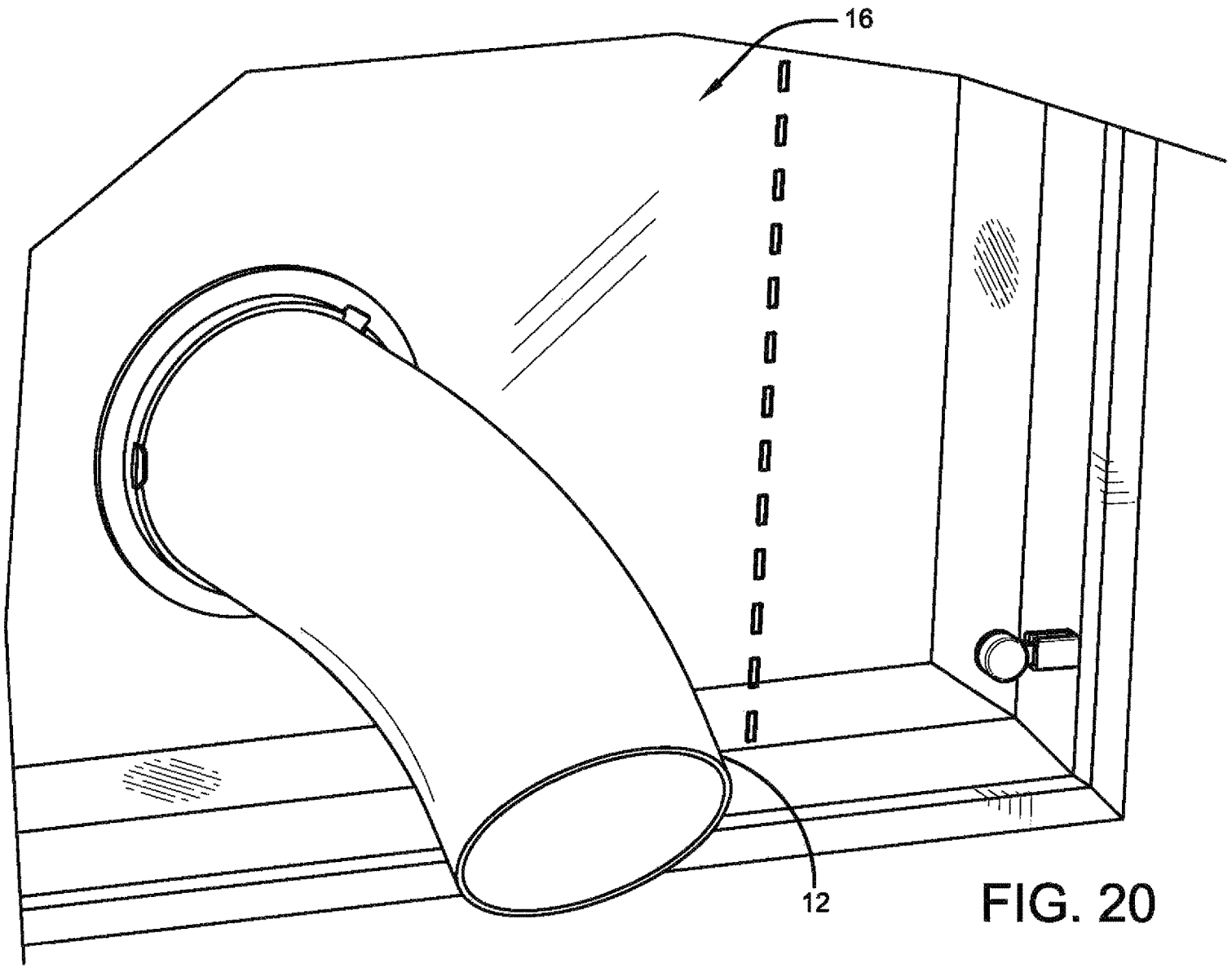
FIG. 20 is a perspective view showing an exemplary vent hose in connection with the sleeve.

In the exemplary arrangement an adhesive ring 126 is positioned in intermediate relation between the inner side 118 of the sheet and the ring 120 of the sleeve. The exemplary adhesive ring 126 includes an outer portion 128 that is configured to adhesively engage inner side 118 of the sheet and extend in surrounding relation of the opening 14. The exemplary adhesive ring 126 further includes an inner portion 130 which is configured to adhesively engage the inward facing surface of the ring 120 of the sleeve 114. As a result the exemplary adhesive ring 126 is operative to hold the sleeve 114 in fixed attached engagement with the sheet 16 so that the vent hose 12 can be securely releasably engaged therewith as represented in FIG. 20.

As will be appreciated, the exemplary configuration of the window vent assembly 15 enables the portable air conditioner to discharge the heat removed from the room in which the air conditioner is positioned. The exemplary configuration enables the window 24 to be rotated between the open and closed positions while the sheet 16 is in position closing the frame opening 22. In exemplary arrangements the sheet 16 and clips 62, 64 do not interfere with the operation of crank handles, locking levers or other hardware associated with the swing out window. As a result with the assembly of the exemplary embodiment, the window 24 can be selectively opened and closed and locked or unlocked while the sheet 16 and the attached vent hose remain in position. When it is desired to use the portable air conditioner the window 24 may be moved from the closed position to the open position using a crank or other suitable mechanism associated with the window assembly. With the window in the open position the portable air conditioner is enabled to release the heat removed from the room through the opening 14 to the external environment. This is accomplished without insects or other items in the external environment being able to enter the interior of the building.

Further in the exemplary arrangement when it is no longer desired to use the portable air conditioner in the area adjacent to the window, the sheet 16 may be readily removed. The clips that are attached to the window frame may remain in place until the next time that it is desired to install the window vent assembly 15 in the particular window. The exemplary arrangement provides for a compact and attractive way for a window having a swing out configuration to have a portable air conditioner vent installed in connection therewith in a fast and cost-effective manner.

Thus the exemplary embodiments described herein achieve improved operation, eliminate difficulties encountered in the use of prior devices and systems, and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the useful features are not limited to the exact features shown and described.

Further in the following claims any feature described as a means for performing a function shall be construed as encompassing any means known to those skilled in the art as being capable of carrying out the recited function, and shall not be deemed limited to the particular means shown or described for performing the recited function in the foregoing description, or mere equivalents thereof.

Having described the features, discoveries and principles of the exemplary embodiments, the manner in which they are constructed and operated, and the advantages and useful results attained, the new and useful structures, devices, elements, arrangements, parts, combinations, systems, equipment, operations, methods, processes and relationships are set forth in the appended claims.

We claim:

1. An apparatus comprising:

a window vent assembly, wherein the window vent assembly is configured for use with a portable air conditioner that has an air vent hose, and a swing out window assembly that includes a frame that bounds a rectangular frame opening, a window that is movably mounted in operative connection with the frame, and that is rotatably movable about a vertical axis between a closed position in which the window closes the frame opening, and an open position in which at least one lateral side of the window is disposed outward from the frame opening, wherein the window vent assembly includes:

a substantially rigid plastic sheet, the sheet including a sheet opening configured to be operatively connected to the air vent hose of the portable air conditioner, a plurality of scored break lines, wherein the break lines are configured to enable separation of portions of the sheet along each break line by application of bending force to the sheet along the respective break line, whereby the break lines enable separating portions from the sheet such that the remaining sheet corresponds in size to the frame opening, a plurality of first self-adhesive clips and second self-adhesive clips, wherein each first clip includes a projection and each second clip includes a recess configured to engage a respective projection, wherein the first clips are each configured to be adhesively attached in fixed relation with one of the sheet and the frame, and wherein the second clips are each configured to be adhesively attached in fixed relation with the other of the sheet and the frame, such that the projection associated with each first clip is engageable with the recess of each respective second clip, wherein the engagement of the respective first and second clips is usable to hold the remaining sheet in fixed engagement with the frame to close the frame opening, and the air conditioner is enabled to be vented through the vent hose in operative connection with the sheet opening when the window is in the open position.

2. The apparatus according to claim 1 wherein the first clip includes a base, a top, wherein the top is rotatable relative to the base and wherein the top includes the projection.

3. The apparatus according to claim 2 wherein each second clip includes a body, wherein the body bounds the recess on at least two sides, wherein rotation of the top in a first rotational direction is operative to cause the projection of the respective first clip to engage the recess of the respective second clip.

4. The apparatus according to claim 3 wherein in the engaged position of the projection of the respective first clip with the recess of the respective second clip, rotation of the top in a second rotational direction opposed of the first rotational direction is operative to cause the projection to disengage from the recess.

5. The apparatus according to claim 3 wherein the body of each second clip includes a first body side, wherein the first body side includes an adhesive face and an outer face, and a second body side having an inner face disposed from and parallel to the outer face of the first body side, wherein the outer face of the first body side and the inner face of the second body side bound the recess of the respective second clip, wherein in the engaged position of a respective first clip with a respective second clip, the projection of the respective first clip extends intermediate of the inner face and the outer face of the respective second clip.

6. The apparatus according to claim 5 wherein the recess of each second clip is further bounded by a bounding wall face that extends transversely between the inner face and the outer face, wherein in the engaged position of the respective first clip and the second clip with the projection engaged in the recess, the bounding wall face is operative to engage the projection and prevent further rotation of the top in the first rotational direction.

7. The apparatus according to claim 6 wherein each respective body has a substantially rectangular shape, and is comprised of four substantially planar sides and includes two open sides, wherein the projection of the respective first clip is engageable in the respective recess of the respective second clip by rotational movement into the recess through the two open sides.

8. The apparatus according to claim 6 wherein the sheet includes a rectangular sheet including four corners, wherein the sheet includes a rectangular plate portion that includes one of the corners and includes no break lines, wherein the plate portion includes the sheet opening.

9. The apparatus according to claim 8 wherein the rectangular sheet is bounded by four outer sides, wherein the plate portion is bounded by two of the outer sides, wherein the two outer sides that bound the plate portion extend perpendicular with respect to one another, wherein each of the break lines extends parallel to one of the outer sides that bound the plate portion.

10. The apparatus according to claim 9 wherein the remaining sheet when positioned in closing relation of the frame opening includes an inner side that faces inward in the frame opening, and further including a sleeve extending in aligned relation with the sheet opening, wherein the sleeve includes an annular tube portion that extends inwardly relative to the sheet opening and a radially outward extending ring that is configured to be in surrounding relation of the sheet opening.

11. The apparatus according to claim 10 further including an adhesive ring, wherein the adhesive ring includes an annular inner portion, wherein the annular inner portion is configured to adhesively engage the outward extending ring of the sleeve, an annular outer portion, wherein the annular outer portion is configured to adhesively engage the inner side of the sheet and extend in surrounding relation of the sheet opening.

12. The apparatus according to claim 11 wherein the sleeve includes at least one coupling connector configured to engage the vent hose.

13. The apparatus according to claim 12 wherein each of the plurality of first clips is attached to the sheet, and each of the plurality of second clips is attached to the frame.

14. The apparatus according to claim 9 further including a sleeve, wherein the sleeve is configured to be in operative connection with the sheet opening, wherein the sleeve includes at least one coupling connector, wherein the at least one coupling connector is configured to engage the vent hose.

15. The apparatus according to claim 2 wherein each second clip has a substantially rectangular shape including four substantially planar sides and two open sides, wherein the projection of a respective first clip is engageable in the respective recess of the second clip by rotational movement into the recess through the two open sides.

16. The apparatus according to claim 1 wherein each first clip includes a base, wherein the base includes a first side including a self-adhesive face, and a second side opposed of the first side, wherein the second side includes one of an arcuate projection or an arcuate recess, a top, wherein the top includes the projection, and wherein the top includes the other of the arcuate projection or the arcuate recess, wherein the arcuate projection is engaged with the arcuate recess such that the top is held in rotatable movable engagement with the base through a range of relative angular positions, and wherein in at least one relative angular position of the top relative to the base that is disposed away from angular position in which the projection is in engagement with the recess of the second clip, the top is both separable from and engageable with the base.

17. The apparatus according to claim 16 wherein the second side of each first clip is in operative fixed connection with a pair of disposed radially extending arcuate projections, and wherein the top is in operative fixed connection with a pair of disposed radially extending arcuate recesses, and wherein arcuate openings axially extend between the arcuate recesses, wherein when the arcuate projections are positioned fully within the arcuate recesses, the top is axially movable relative to the base to be separable from and engageable with the base.

18. The apparatus according to claim 1 wherein each of the plurality of first clips is attached to the sheet, and each of the plurality of second clips is attached to the frame.

19. The apparatus according to claim 1 wherein the rectangular sheet is bounded by four outer sides and has four corners, wherein the sheet includes a rectangular plate portion, wherein the plate portion includes the sheet opening, includes no break lines, is bounded by two of the outer sides that extend perpendicular to one another and one of the four corners, wherein each of the break lines extend parallel to one of the outer sides that bound the plate portion.

20. The apparatus according to claim 1 further including a sleeve, wherein the sleeve includes an annular tube portion configured to extend away from the sheet opening, and a ring portion that extends radially outward from the annular tube portion, an adhesive ring, wherein the adhesive ring includes an inner portion that adhesively engages the ring portion of the sleeve, an outer portion that adhesively engages the sheet and extends in wherein the sleeve includes at least one coupling connector configured to engage the vent hose.

21. A window vent assembly comprising:

a substantially rigid plastic sheet, the sheet including a sheet opening configured to be operatively connected to a air vent hose of a portable air conditioner, a plurality of scored break lines, wherein the break lines are configured to enable separation of portions of the sheet along each break line by application of bending force to the sheet along the respective break line, whereby the break lines enable separating portions of the sheet such that the remaining sheet corresponds in size to a rectangular frame opening in a frame of a swing out window assembly, which rectangular frame opening the remaining sheet is configured to close, wherein the swing out window assembly with which the window vent assembly is configured to be utilized includes a window that is movably mounted in operative connection with the frame and that is rotatably movable about a vertical axis between a closed position in which the window closes the frame opening, and an open position in which at least one lateral side of the window is disposed outward from the frame opening, a plurality of first self-adhesive clips and second self-adhesive clips, wherein each first clip includes a projection and each second clip includes a recess configured to engage a respective projection, wherein the first clips are each configured to be adhesively attached in fixed relation with one of the sheet and the frame, wherein the second clips are each configured to be adhesively attached in fixed relation with the other of the sheet and the frame, wherein the projection associated with each of first clip is engageable with the recess of each respective second clip, wherein engagement of the respective first and second clips is operable to hold the remaining sheet in fixed operative engagement with the frame to close the frame opening, whereby the air conditioner is enabled to be vented through the sheet opening when the window is in the open position via the sheet opening being operatively connected with the vent hose.

* * * * *